US007098855B2

(12) United States Patent
Kotzin et al.

(10) Patent No.: US 7,098,855 B2
(45) Date of Patent: Aug. 29, 2006

(54) EMERGENCY DEPLOYABLE GPS ANTENNA

(75) Inventors: Michael Kotzin, Buffalo Grove, IL (US); Thomas J. Walczak, Woodstock, IL (US); Eric Krenz, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 103 days.

(21) Appl. No.: 10/628,200

(22) Filed: Jul. 28, 2003

(65) Prior Publication Data

US 2005/0024269 A1 Feb. 3, 2005

(51) Int. Cl.
*H01Q 1/24* (2006.01)
*H01Q 1/10* (2006.01)

(52) U.S. Cl. ..... 343/702; 343/903

(58) Field of Classification Search ..... 343/702, 343/901, 903

See application file for complete search history.

(56) References Cited

U.S. PATENT DOCUMENTS

| | | | | |
|---|---|---|---|---|
| 5,451,974 | A * | 9/1995 | Marino | 343/895 |
| 5,943,018 | A * | 8/1999 | Miller | 343/702 |
| 6,337,671 | B1 * | 1/2002 | Lee | 343/901 |
| 6,573,868 | B1 * | 6/2003 | Johnson et al. | 343/702 |
| 6,662,021 | B1 * | 12/2003 | Kang et al. | 455/553.1 |

* cited by examiner

*Primary Examiner*—Shih-Chao Chen
(74) *Attorney, Agent, or Firm*—Roland K. Bowler, II

(57) ABSTRACT

The electronic device is for at least one of transmitting and receiving signals, has a housing 500 and at least a GPS (Global Positioning System) antenna 510 that is operatively connected to the housing 500. A control system 708 automatically moves the GPS antenna 510 from a docked position relative to the housing 500 to a deployed position relative to the housing 500 in response to an occurrence of at least one predetermined event.

24 Claims, 10 Drawing Sheets

EMERGENCY DEPLOYABLE GPS ANTENNA

FIELD OF THE INVENTION

In general terms, the present invention relates to electronic devices that have deployable antennas, and in general to handheld two-way radio transceivers that receive GPS (Global Positioning System) signals.

BACKGROUND OF THE INVENTION

Handheld two-way radio transceivers (also known as cell phones) are well known in the art. Recent designs for such transceivers do not require a manually extendable antenna for cellular operation. It is also known to provide cellular phones with the feature of receiving a GPS signal from a GPS satellite for determining location of the cell phone. GPS refers generically to satellite positioning systems comprising a system or constellation of navigation satellites orbiting a celestial body. Exemplary earth-orbiting satellite positioning system constellations include NAVSTAR GPS, GLONASS, and Galileo. Cell phones receive GPS signals so that operators in a public safety answering center are able to determine the location of the cell phone by receiving a GPS signal via the cell phone. This feature assists in locating cell phones and their users during emergency situations. In the Global Positioning System each GPS satellite transmits its own position, its time, and a long pseudo random noise code. The noise code is used by the receiver to calculate range. Satellite position and time are derived from on-board celestial navigation equipment and atomic clocks accurate to one second in 300,000 years. But the ranging is the heart of GPS. Both in the receiver, and in the satellite, a very long sequence of apparently random bits are generated. By comparing internal stream of bits in the receiver to the precisely duplicate received bits from the satellite, and "aligning" the two streams, a shift error or displacement can be calculated representing the precise travel time from satellite to receiver. Since the receiver also knows the precise position of the satellite, and its range from the receiver, a simple triangulation calculation can give two dimensional position (lat/long) from three satellites and additional elevation information from a fourth.

In many situations a blocked environment such as inside a building or a parking garage, GPS does not work well because of the limited visibility the GPS antenna has to the positioning satellites. In such cases, the transceiver may receive inadequate signal power to effectively determine a position of the transceiver. A further factor for inadequate signal power is that the presence of the user in close proximity to the GPS antenna reduces the signal power. Field testing with server assisted GPS technology has shown that the sensitivity of transceivers is approximately −150 dBm. Testing has also shown that the signal strength of the satellites is approximately −155 dBm to −160 dBm in blocked environments. This means that an increase in sensitivity of between 5 dB and 10 dB is required for improved performance. In the prior art this level of improvement is achieved using larger antennas that are held away from the body of the user and that are manually deployed. However, the design of modern day cell phones does not provide the option of an antenna which can be manually deployed by the user.

Thus, there is a need in the prior art for an automatically deployable antenna for receiving GPS signals, especially in emergency situations.

BRIEF DESCRIPTION OF THE DRAWINGS

The features of the present invention which are believed to be novel are set forth with particularity in the appended claims. The invention, together with further objects and advantages, may best be understood by reference to the following description taken in conjunction with the accompanying drawings, in the several figures of which reference numerals identify like elements, and in which:

DETAILED DESCRIPTION OF A PREFERRED EMBODIMENT OF THE INVENTION

In general terms the present invention is an electronic device for at least one of transmitting and receiving signals. The device has a housing and at least a GPS antenna that is operatively connected to the housing. A control system automatically moves the GPS antenna from a docked position relative to the housing to a deployed position relative to the housing in response to an occurrence of at least one predetermined event.

More specifically, the present invention is a handheld two-way radio transceiver having a helix cellular/GPS antenna. In addition, an inflatable monopole GPS antenna has a docked position relative to the housing and a deployed position relative to the housing. An ejection device inflates the monopole GPS antenna and thereby moves the antenna from the docked position to the deployed position. A control system automatically deploys the GPS antenna utilizing the ejection device in response to an occurrence of at least one predetermined event. The invention is further a method for deploying a GPS antenna in an electronic device and comprises the steps of: detecting the occurrence of at least one predetermined event; and automatically moving the GPS antenna from the docked position relative to a housing of the electronic device to the deployed position relative to the housing of electronic device; the deployed position providing increased signal quality for receiving a GPS signal. In an embodiment of the present invention the predetermined event is the activation of a series of predetermined keys, such as 911, on a keypad of the transceiver. The event can also be reception of a GPS request from a public safety answering center, or detection of an inadequate signal level from the GPS satellite.

The present invention provides an emergency deployable GPS antenna system for use on a portable device, such as a cell phone (also referred to as a subscriber unit). This antenna may be deployed either by the user or by a public safety answering center. The antenna, once deployed, provides significantly improved performance. The antenna system may or may not be reusable. Deployment of the antenna may be initiated by the user by pressing a particular button on the cell phone or by activation of a certain sequence of keys on a keypad of the cell phone, such as 911. The cell phone, upon detection of an emergency call, automatically deploys the GPS antenna if the signal quality of a received GPS signal is below a predetermined threshold.

Figure 1:
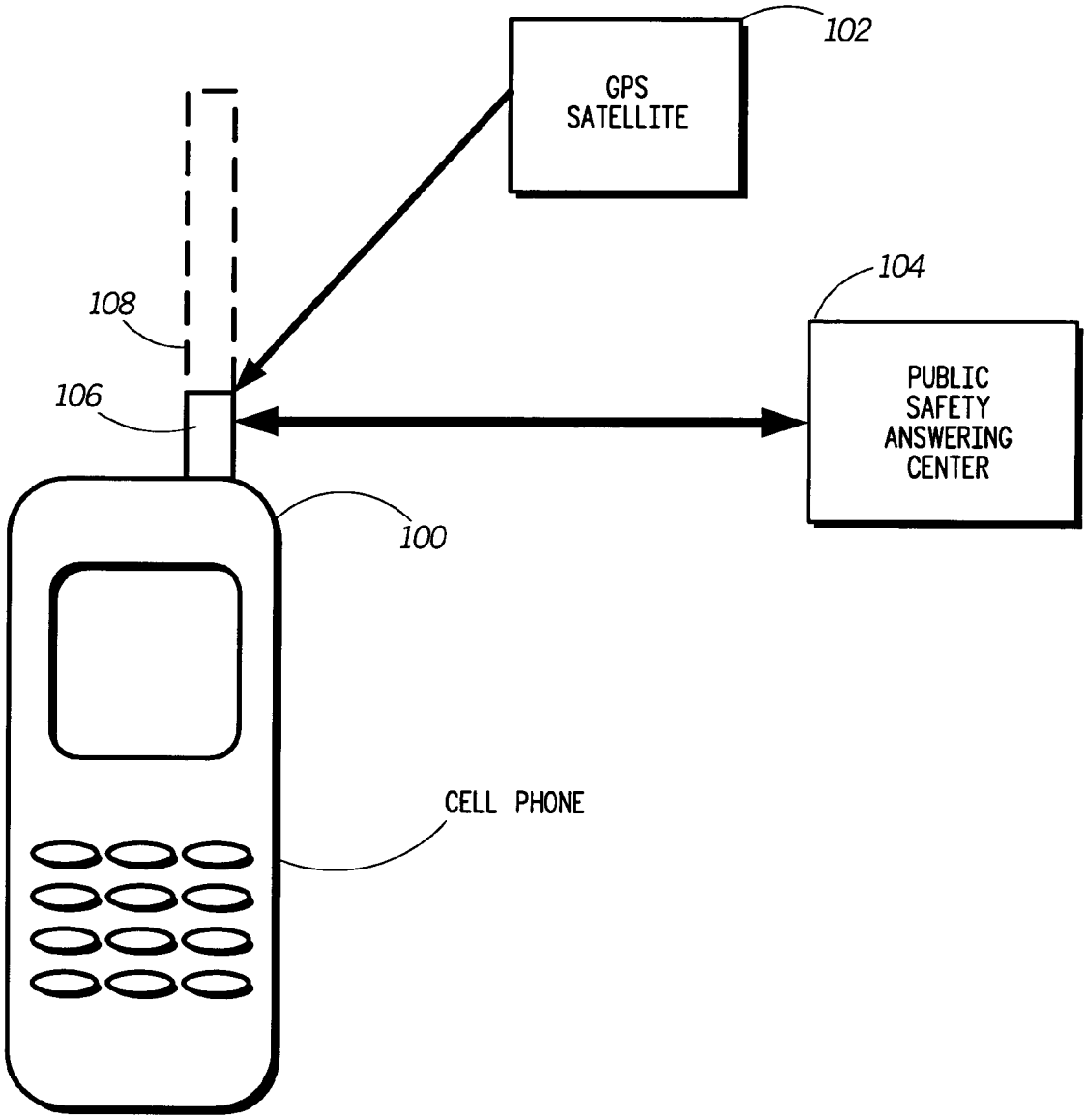
FIG. 1 is a general diagram depicting a cell phone that receives signals from a GPS satellite and that communications with the public safety answering center.

FIG. 1 depicts a handheld two-way radio transceiver, or cell phone 101 that receives signals from a GPS satellite 102 and that also transmits and receives signals with a public safety answering center 104. The cell phone 100 has a built in cellular/GPS antenna 106 for receiving and sending signals. In addition, an inventive feature of the cell phone is the provision of a further GPS antenna 108 which has a docked position and a deployed position, the deployed position being indicated by the dotted line in FIG. 1.

Figure 2:
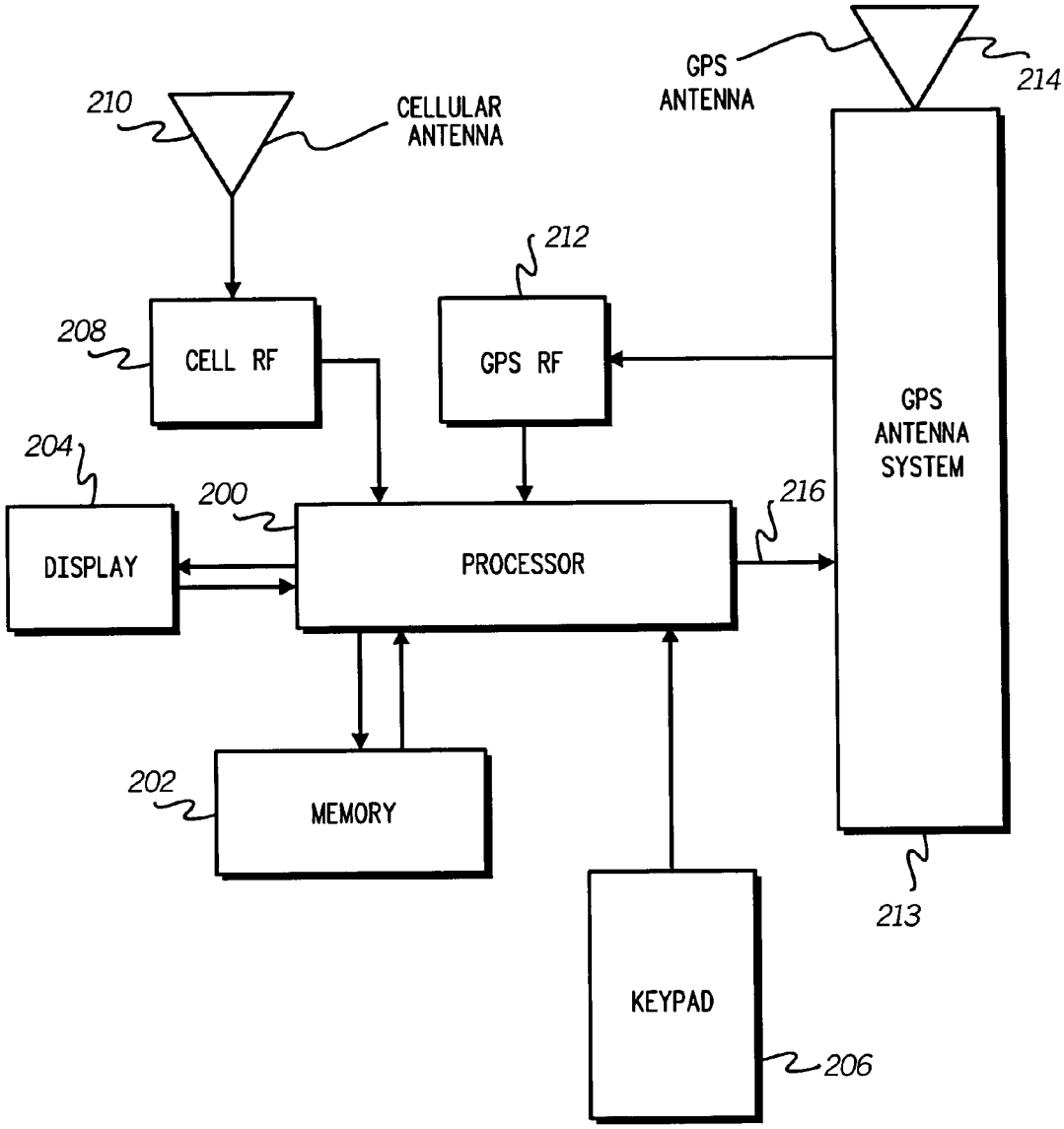
FIG. 2 is a block diagram of the FIG. 1 cell phone.

FIG. 2 is a block diagram of the cell phone 100 in FIG. 1. A processor 200 is operatively connected with a memory 202, a display 204 and a keypad, or input device, 206. The processor 200 is also connected to a radio frequency circuit 208 for processing received signals from a cellular antenna 210 on cellular frequencies. The processor 200 also receives data from a GPS radio frequency circuit 212 that processes GPS signals received by a GPS antenna system 213. According to the present invention the GPS antenna 214 has a docked position and a deployed position. The processor 200 therefore has a signal line 216 for causing the GPS antenna system 213 to move the GPS antenna 214 from the docked position to the deployed position as will be explained below.

Figure 3:
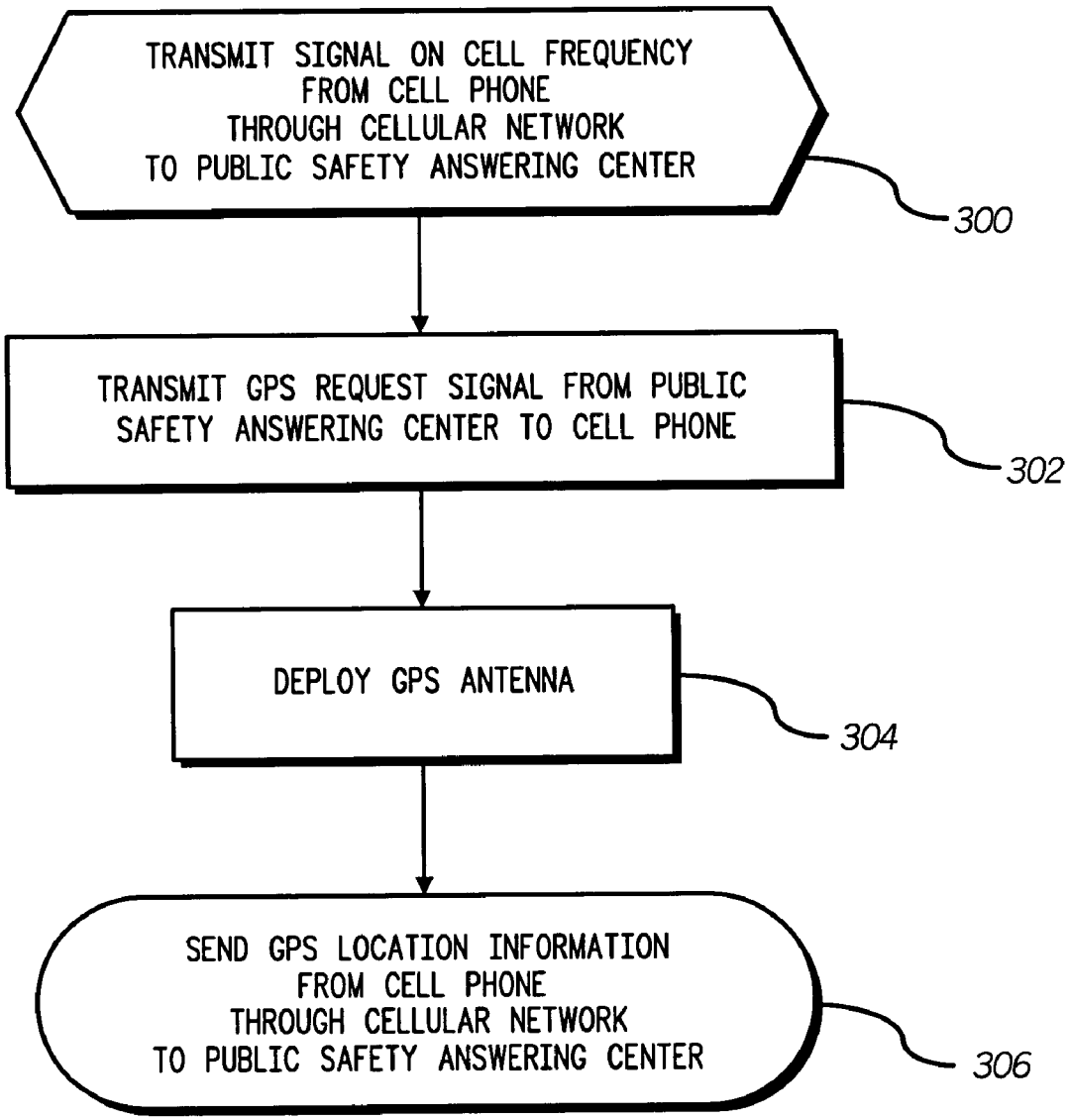
FIGS. 3 and 4 are flow diagrams depicting the steps of the method of the present invention.
Figure 4:
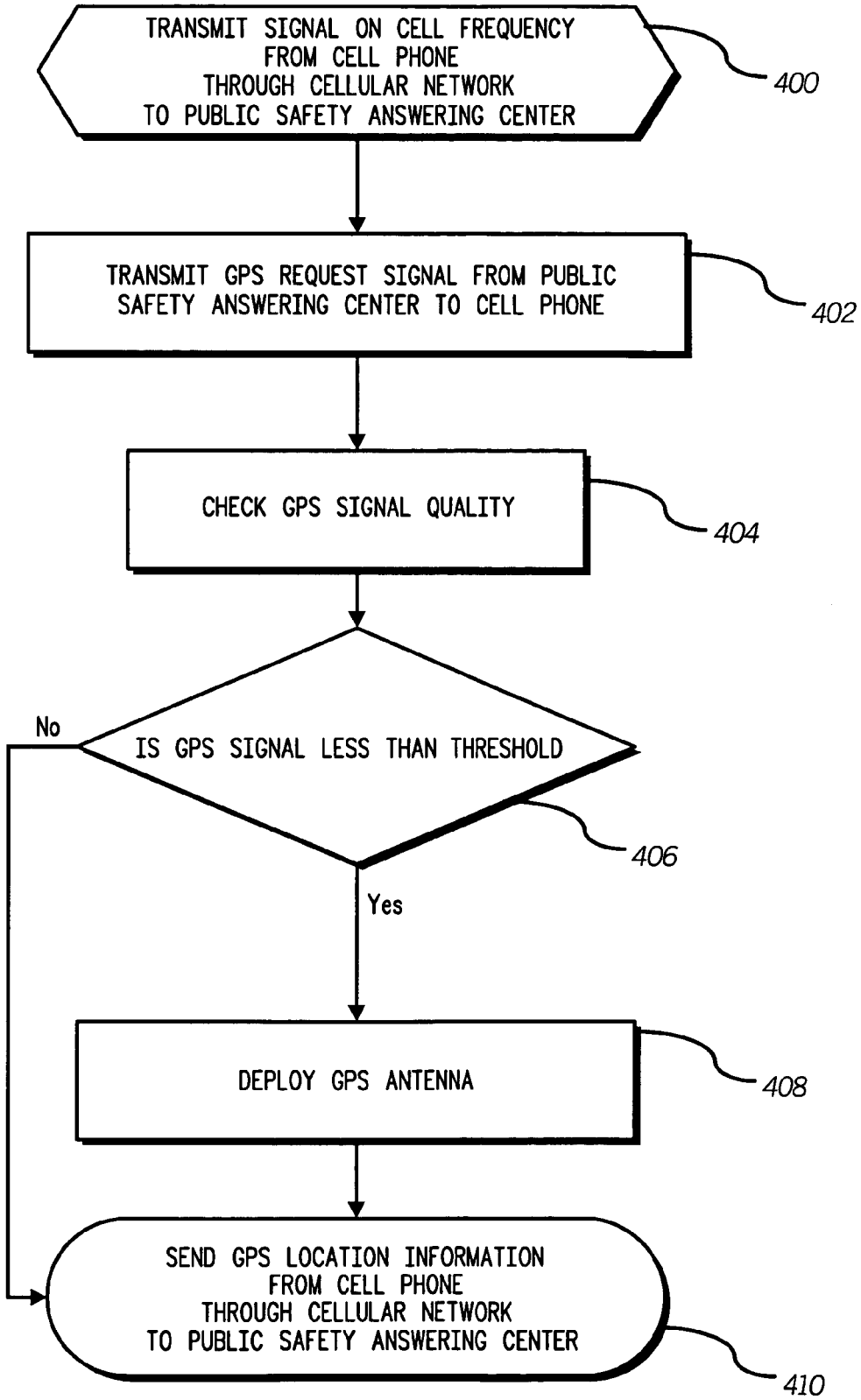

General operation of the cell phone depicted in FIGS. 1 and 2 is set forth in the flow charts of FIGS. 3 and 4. In the FIG. 3 flowchart, the user of the cell phone transmits a signal on a cellular frequency, the signal being sent from the cell phone through a cellular network to a public safety answering center in step 300. In a second step 302 the public safety answering center sends a signal over the cell frequency or other suitable frequency to the cell phone requesting transmission of a GPS signal. It should be noted that this GPS signal can also be automatically sent as soon as the cell phone sends a cellular frequency call to the public safety answering center. In response to the request by the public safety answering center, in step 304 the cell phone automatically deploys the GPS antenna and in step 306 sends a GPS location information through the cellular network to the public safety answering center.

In another version of the present invention, as set forth in FIG. 4, in a first step 400 the user of the cell phone transmits a signal over the cellular frequency to the public safety answering center. The public safety answering center then in a second step 402 requests from the cell phone that a GPS signal be sent. In step 404 the processor 200 automatically checks signal quality (such as signal strength) of the GPS signal that is received by the cell phone. The cell phone then compares the signal strength to a predetermined antenna deployment threshold in step 406. If the signal strength is below the predetermined antenna deployment threshold, then in step 408 the cell phone automatically deploys the GPS antenna, moving it from its docked position to the deploy position. In step 410, the cell phone then sends GPS location information, derived from a received GPS signal, to the public safety answering center. If in step 406 the signal strength is greater than the predetermined antenna deployment threshold then the cell phone does not automatically deploy the GPS antenna and proceeds to step 410, sending the GPS signal to the public safety answering center.

Figure 5:
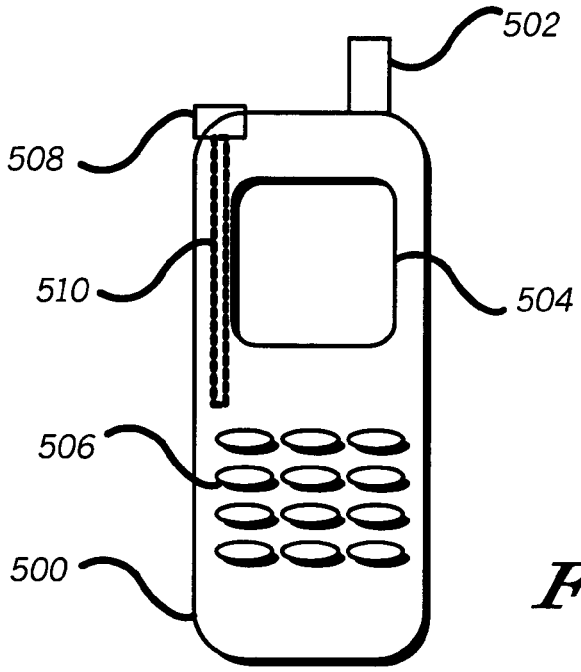
FIG. 5 depicts a handheld two-way radio transceiver according to the present invention with a GPS antenna in a docked position.
Figure 6:
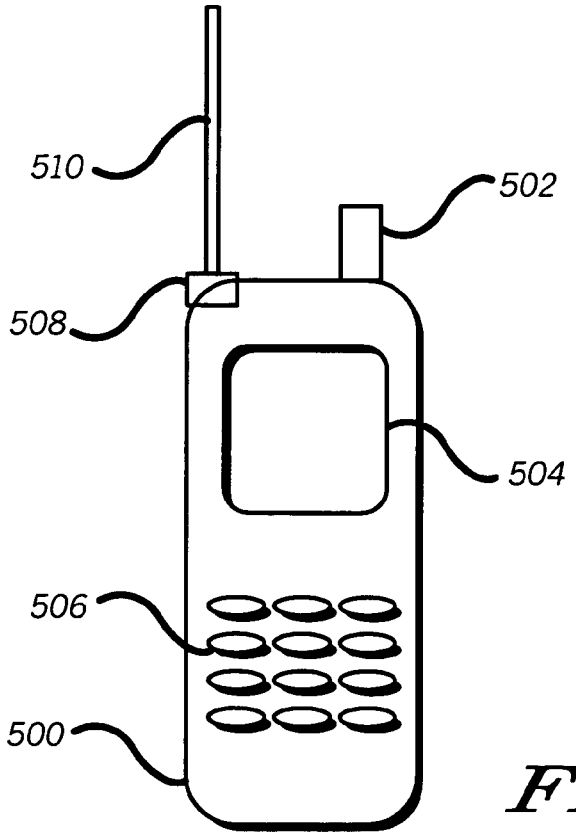
FIG. 6 depicts the FIG. 5 transceiver with the GPS antenna in a deployed position.
Figure 7:
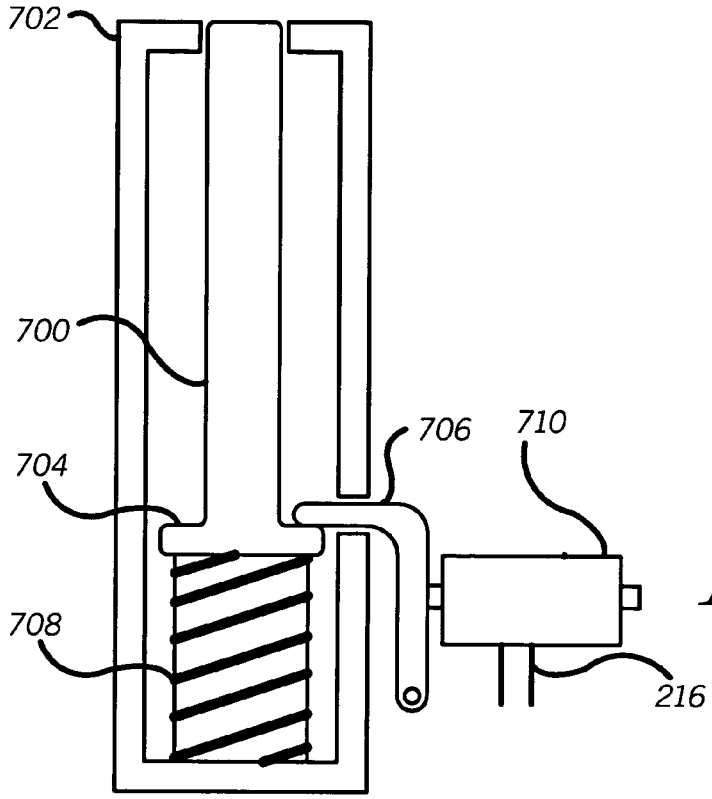
FIG. 7 depicts an embodiment of the present invention for deploying the GPS antenna from a docked position to a deployed position.

FIGS. 5 and 6 depict a cell phone 500 having a standard cell phone antenna 502, a display area 504 and a key pad 506. In addition, the cell phone 500 has a patch antenna 508, as known in the art, for receiving GPS signals. The cell phone 500 furthermore has a half wave monopole antenna 510, as known in the art, for receiving GPS signals as well. FIG. 5 shows the monopole antenna in a docked position in FIG. 5 and shows the monopole antenna 510 in a deployed position in FIG. 6. In the docked position the antenna 510 is not connected to the GPS circuit, while in the deployed position the antenna 510 is connected to the GPS circuit. In the docked position of FIG. 5 the monopole antenna 510 is contained within the cell phone of 500 and moves linearly to the deployed position depicted in FIG. 6. A number of configurations for the structure of the deployable GPS antenna 510 in FIGS. 5 and 6 are depicted in detail in FIGS. 7–11 although any suitable linear or nonlinear configuration may be used. In FIG. 7, a GPS antenna 700 is contained in a docked position within an antenna chamber 702. The GPS antenna 700 has a base 704 (also referred to in general as a connection section) which is engaged by detent 706. A spring structure 708 (also generally referred to as an ejection device) moves the GPS antenna 700 from the docked position to the deployed position when the detent 706 is withdrawn from engagement with the base 704 by a solenoid 710 that is activated by a signal on signal line 216. The spring structure can have a variety of forms including helical and non-helical configurations.

Figure 8:
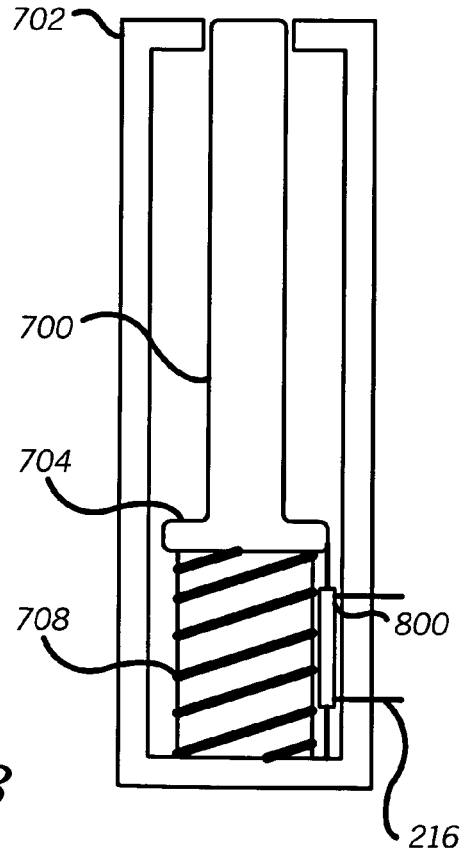
FIGS. 8–11 depict alternative structures for deployment of the GPS antenna.

In FIG. 8 the base 704 of the GPS antenna 700 is retained in the docked position by a fusable link 800 that is connected between the base 704 and a bottom of the antenna chamber 702. When the fusable link 800 is blown, the spring structure 708 moves the GPS antenna 700 from the docked position to the deployed position.

Figure 9:
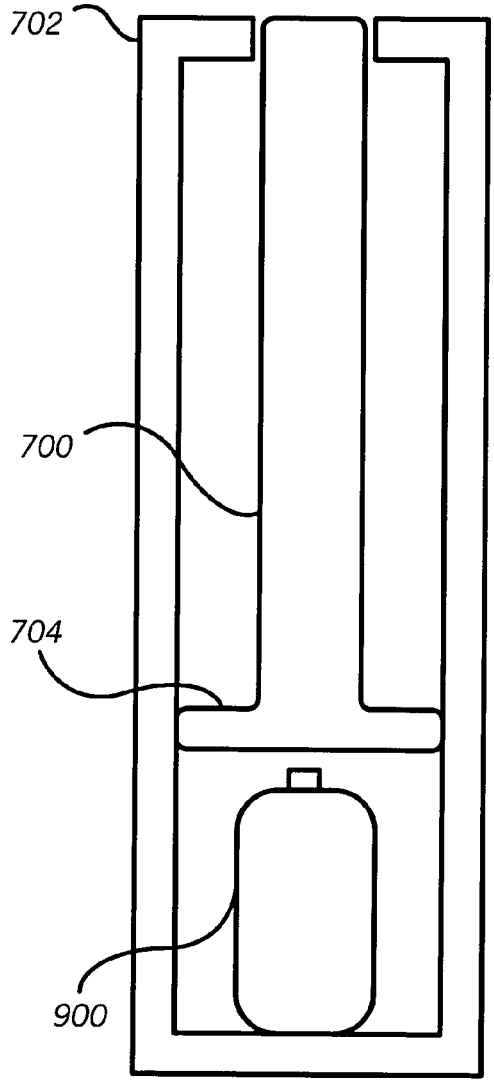

In FIG. 9 a compressed gas cylinder 900 is located below the base 704 of the GPS antenna 700. The base 704 in dimensioned to form a sufficient seal with an interior of the antenna chamber 702 such that when the compressed gas cylinder 900 releases gas, the antenna 700 moves from the docked position to the deployed position by expansion of the gas below the base 704.

Figure 10:
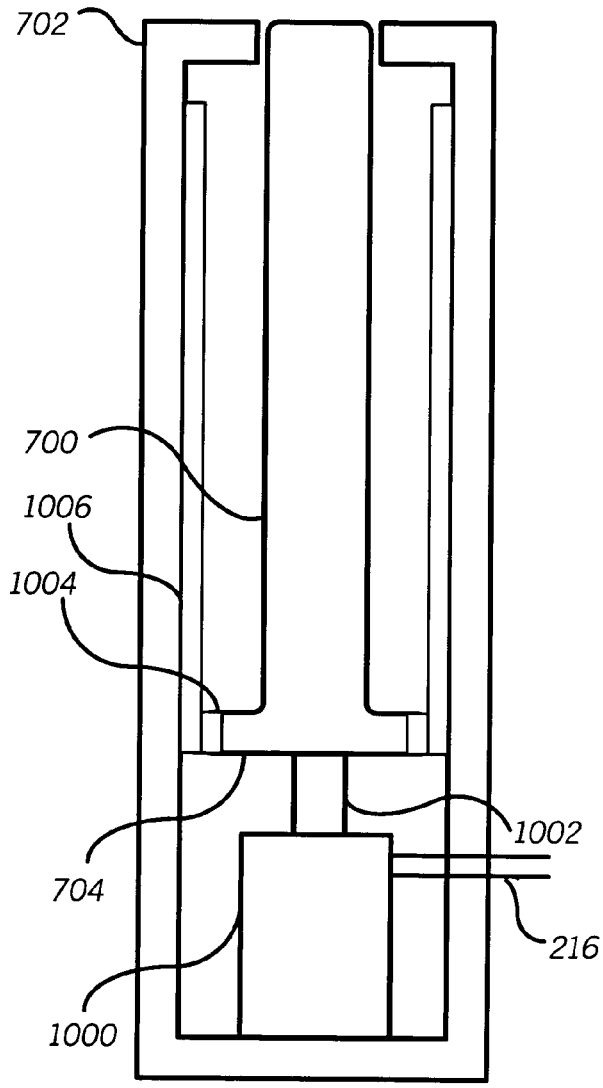

In FIG. 10, a motor 1000 has a shaft 1002 attached to the base 704 of the GPS antenna 700. The antenna 700 has teeth 1004 which engage teeth 1006 on an interior surface of the antenna chamber 702 such that, when the motor turns the antenna 700, it moves from the docked position to the deployed position. The teeth 1004/1006 are configured to advance the antenna when the motor 1000 rotates the antenna 700.

Figure 11:
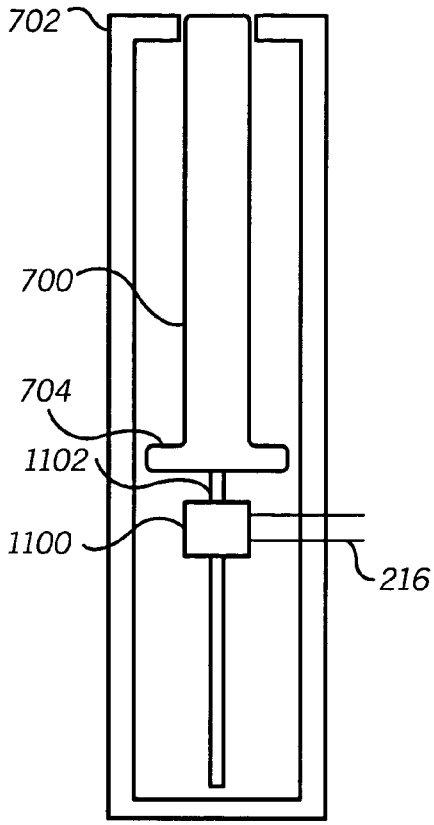

In FIG. 11 a solenoid 1100 is connected to the base 704 of the antenna 700 and has a plunger 1102 which moves the antenna 700 from the docked position to the deployed position when a signal is received by the solenoid 1100.

Figure 12:
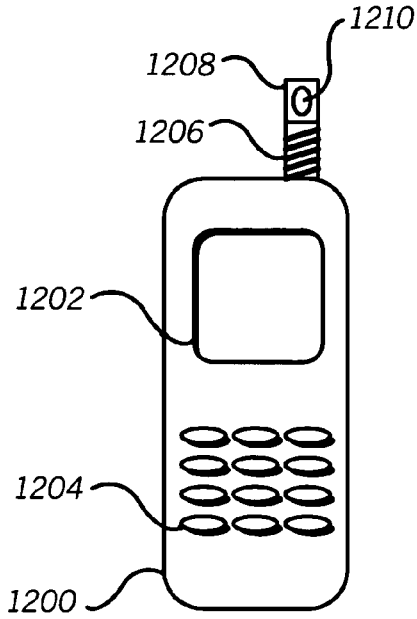
FIG. 12 depicts an embodiment of the present invention in which the GPS antenna is an inflatable monopole antenna, the antenna being depicted in a docked position.
Figure 13:
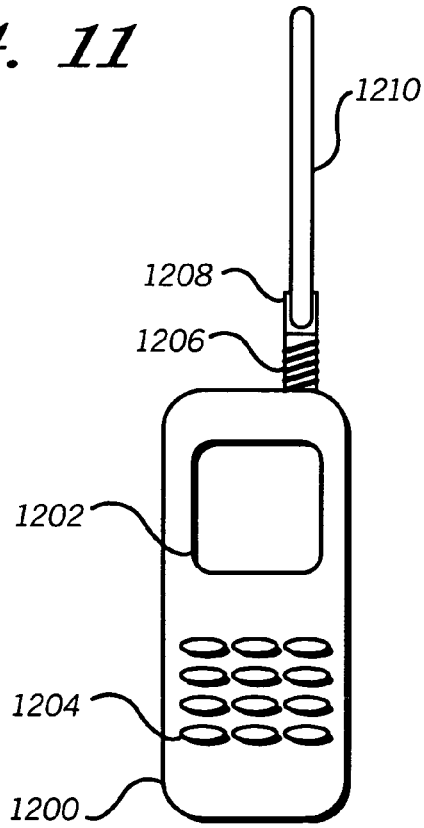
FIG. 13 depicts the FIG. 12 antenna in a deployed position.

FIGS. 12 and 13 depict a cell phone 1200 having a display area 1202 and a keypad 1204. The cell phone 1200 has a combined cell and GPS antenna 1206. This antenna 1206 is, for example, a helical antenna. In an upper portion 1208 of the combined cell and GPS antenna 1206 is stowed in a docked position a half-wave parasitic GPS antenna 1210. FIG. 13 shows the half-wave parasitic GPS antenna 1210 in the deployed position. In the docked position shown in FIG. 12 the half-wave parasitic GPS antenna 1210 has a configuration such that it has substantially little influence on reception of signals by the combined cell and GPS antenna 1206. In the deployed position depicted in FIG. 13 the GPS antenna 1210 operates by capacitive end coupling with the antenna 1206. GPS antenna 1210 can be, for example, a metallized mylar balloon which is inflated to move the GPS antenna from the docked position to the deployed position. Inflatable structures can also be used that have coatings of aluminum, silver or copper, for example. Coatings of other substances suitable for receiving signals could also be utilized for the GPS antenna 1210. The GPS antenna 1210 can be fully metallized or partially metallized in a particular pattern to support a desired antenna operation.

Figure 14:
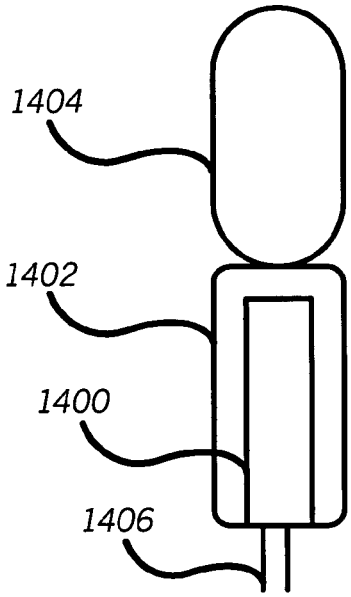
FIGS. 14–16 depict various embodiments of an inflatable monopole GPS antenna according to the present invention.

FIG. 14 depicts an airbag-type device 1400 which is contained within a combined cell and GPS antenna 1402. A deployable GPS antenna 1404 is attached atop the combined cell and GPS antenna 1402 and is operatively connected with the "airbag" 1400. When a signal is received on leads 1406, the airbag 1400 inflates the mylar antenna 1404 causing it to be moved to its deployed position. The "airbag" device 1400 can be of a chemical type similar to those used in airbag structures for automobiles, for example.

Figure 15:
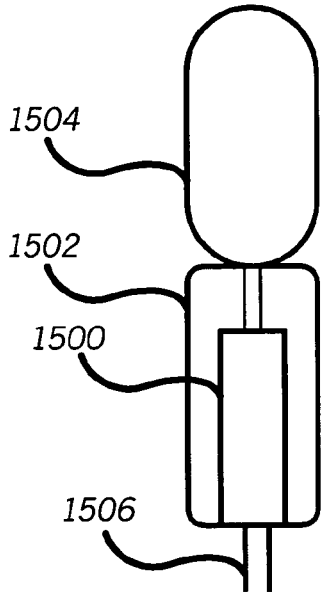

FIG. 15 shows a compressed gas cylinder 1500 contained within the combined cell and GPS antenna 1502 which is used for inflating the mylar GPS antenna 1504 that is affixed atop the antenna 1502 and that is operatively connected to the compressed gas cylinder 1500. A signal on leads 1506 effects operation of the compressed gas cylinder 1500.

Figure 16:
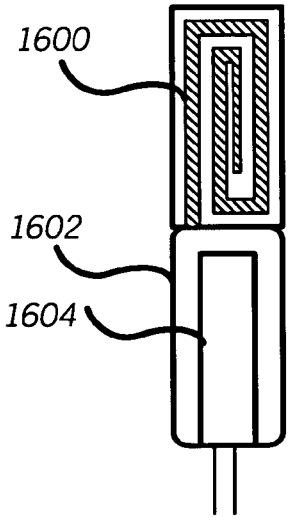

FIG. 16 shows that the GPS mylar antenna 1600 can be folded or coiled into a predetermined shape for the docked position atop the combined cell and GPS antenna 1602. The GPS antenna 1600 is inflated from the docked position to the deployed position by, for example, an airbag 1604 contained in the combined cell and GPS antenna 1602.

Figure 17:
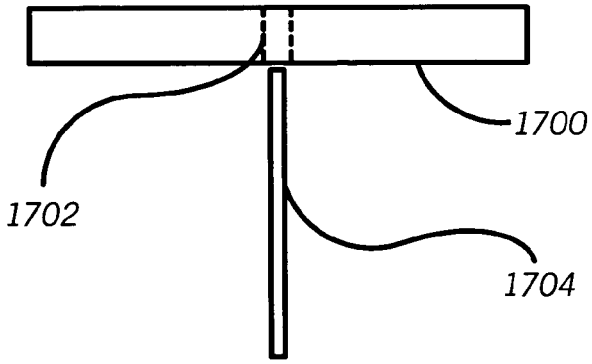
FIG. 17 depicts the monopole GPS antenna relative to a microstrip patch antenna for cellular and for GPS operation.

FIGS. 5 and 6 depicted a cell phone 500 having a patch antenna 508 for receiving GPS signals under "normal" conditions, that is, when signal levels received by the patch antenna 508 are strong enough to be usable. FIG. 17 shows in more detail a patch antenna 1700 which has a central aperture 1702. It is known in the art that a central aperture 1702 can be formed in the patch antenna 1700 without degrading operation of the patch antenna 1700. The GPS antenna 1704 is deployed from a docked position to a deployed position through the center aperture 1702 of patch antenna 1700. It should be noted that patch antennas can be used not only for receiving GPS signals but also to receive cell phone signals on cell frequencies. Thus, various combinations of the patch antennas and helix antennas along with the half-wave monopole emergency GPS antennas can be utilized in cell phones according to the present invention.

Figure 18:
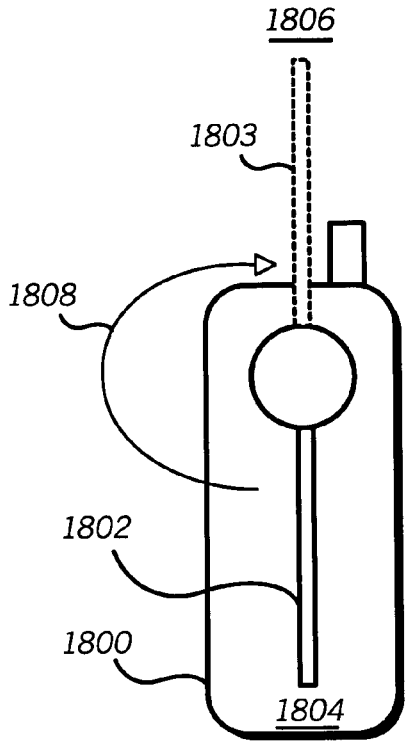
FIG. 18 depicts a further embodiment for deployment of the GPS antenna according to the present invention.

Whereas the GPS antenna was moved linearly in the cell phone depicted in FIGS. 5 and 6, and inflated in the cell phone depicted in FIGS. 12 and 13, the GPS antenna can also be rotated from a docked position to a deployed position. A monopole antenna 1803 is provided for receiving and transmitting of cell frequencies. As shown in FIG. 18 a cell phone 1800 has a GPS antenna 1802 which has a docked position 1804 alongside the cell phone 1800 and a deployed position 1806 which is above the cell phone 1800. The GPS antenna 1802 is rotated as indicated by arrow 1808 from the docked position to the deployed position under the conditions as described above.

Figure 19:
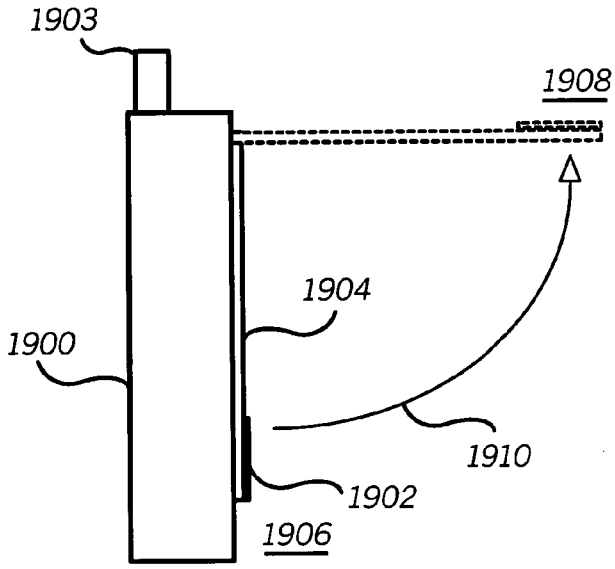
FIG. 19 depicts yet another embodiment for deployment of the GPS antenna according to the present invention.

In FIG. 19 a cell phone 1900 has a monopole antenna 1903 for receiving and transmitting on cell frequencies and a patch antenna 1902 for receiving GPS signals. The patch antenna 1902 is mounted on a movable boom 1904. The patch antenna 1902 has a docked position alongside the cell phone 1900 and a deployed position as shown in FIG. 19 which is away from the cell phone 1900. The patch antenna 1902 springs out from the docked position 1906 to the deployed position 1908 as indicated by arrow 1910. Various spring devices or flexing of the boom 1904 can be utilized for moving the patch antenna 1902 on the boom 1904 from the docked position 1906 to the deployed position 1908.

In the various structures depicted herein the emergency GPS antenna may or may not be reusable. For example, a mechanism as depicted in FIG. 7 which is a detent 706 to engage a base 704 of a GPS antenna 700 provides for a reusable GPS antenna 700. The embodiment depicted in FIGS. 12 and 13 in which the GPS antenna is inflated is not reusable. However, the cell phone could be reusable by replacing the inflated GPS antenna with a new docked GPS antenna. According to the present invention the GPS antenna is moved from the docked position to the deployed position automatically when certain conditions occur. Such conditions, for example, may be when the user enters "911" or other numeric or alphanumeric keys on the cell phone, or when a signal strength of a received GPS signal is below a predetermined threshold. The GPS antenna may also be automatically deployed on receiving a signal from the public safety answering center.

Figure 20:
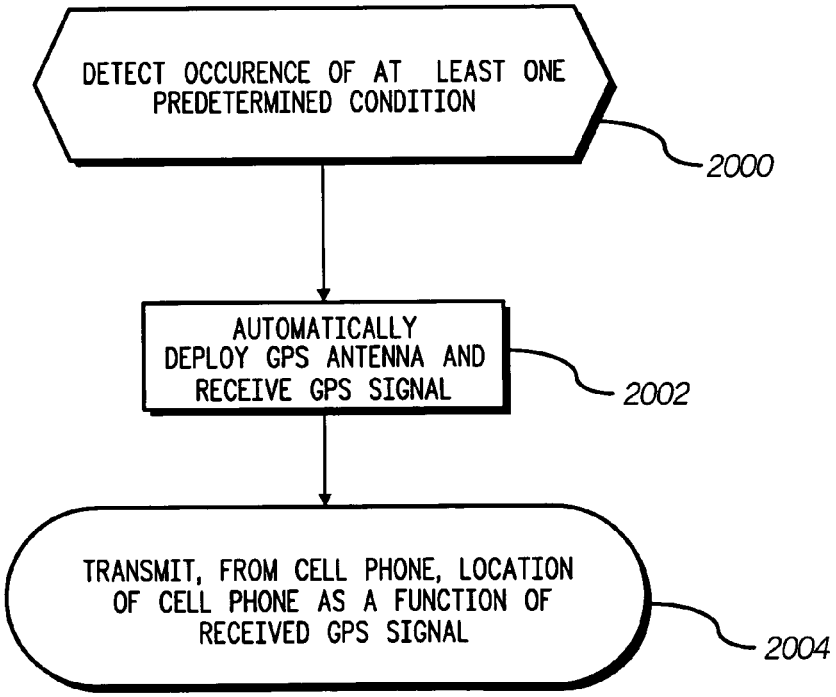
FIG. 20 depicts the general method of the present invention.

In the general terms the method of the present invention is depicted in FIG. 20. In the first step 2000 the occurrence of at least one predetermined event is detected. In response thereto the GPS antenna is automatically deployed in step 2002. A received GPS signal is utilized in step 2004 to transmit the location of the cell phone to, for example, a public safety answering center.

Thus, the present invention fulfills the need in the prior art for an automatically deployable antenna for receiving GPS signals, especially in emergency situations.

It should be understood that the implementation of other variations or modifications of the present invention and its various aspects would be apparent to those of ordinary skill in the art, and that the invention is not limited to the specific embodiment described therein. For example, the present invention encompasses other types of electronic equipment, than cell phone. Also, various other devices and methods can be used to deploy the antenna. It is therefore contemplated to cover by the present invention, any and all modifications, variations or equivalents that fall within the spirit and scope of the basic underlying principals disclosed and claimed herein.

What is claimed is:

1. A portable wireless communication device, comprising:

a radio receiver coupled to an antenna;

a satellite positioning system receiver;

a satellite positioning system antenna coupled to the satellite positioning system receiver;

a deployment system coupled to the satellite positioning system antenna, the deployment system moving the satellite positioning system antenna from a docked position to a deployed position in response to an occurrence of at least one predetermined deployment event.

2. The device according to claim 1, wherein the satellite positioning system antenna is a monopole antenna substantially contained in an antenna chamber, wherein the deployment system has an ejection device, and wherein the satellite positioning system antenna has a connection section operatively connected to the ejection device which moves the satellite positioning system antenna from the docked position to the deployed position.

3. The device according to claim 2 wherein the ejection device is a spring member, and wherein a latch mechanism retains the monopole satellite positioning system antenna in the antenna chamber.

4. The device according to claim 2 wherein the ejection device is a fusable link which connects the connection section of the satellite positioning system antenna to a retaining surface of the antenna chamber.

5. The device according to claim 2, wherein the ejection device is a compressed gas device that is located between the connection section of the satellite positioning system antenna and a retaining surface of the antenna chamber when the satellite positioning system antenna is in the docked position.

6. The device according to claim 2 wherein the ejection mechanism is a motor operatively connected to the satellite positioning system antenna, and wherein the satellite positioning system antenna and the antenna chamber have a gear structure such that when the motor is energized, the satellite positioning system antenna moves from the docked position to the deployed position.

7. The device according to claim 2, wherein the ejection mechanism is a solenoid having a coil and a plunger, wherein the solenoid is contained within a bottom area of the antenna chamber, wherein the plunger has one end connected to the connection section of the satellite positioning system antenna, and wherein upon energizing the coil of the solenoid, the plunger moves the antenna from the docked position to the deployed position.

8. The device according to claim 2, wherein the ejection mechanism is an airbag-type device, wherein the satellite positioning system antenna is an inflatable monopole satellite positioning system antenna that is operatively connected to the airbag-type device, and wherein upon receiving a signal the airbag-type device inflates the satellite positioning system antenna thereby moving the satellite positioning system antenna from the docked position to the deployed position.

9. The device according to claim 1, wherein the satellite positioning system antenna is an inflatable antenna, wherein the satellite positioning system antenna has a compressed configuration for the docked position and inflated by the control system to a monopole satellite positioning system antenna configuration for the deployed position.

10. The device according to claim 9, wherein the satellite positioning system monopole antenna is deployed by an airbag-type device.

11. The device according to claim 9, wherein the monopole satellite positioning system antenna is deployed by a compressed gas device.

12. The device according to claim 1, wherein the device further comprises a quadrifilar helix cellular/satellite positioning system antenna on which an inflatable monopole satellite positioning system antenna is operatively connected.

13. The device according to claim 12 wherein the inflatable satellite positioning system monopole antenna is inflated to move the satellite positioning system monopole antenna from the docked position to the deployed position by one of an airbag-type device and a compressed gas type device.

14. The device according to claim 1, wherein the antenna is a microstrip patch antenna, the satellite positioning system antenna is a monopole antenna, wherein the microstrip patch antenna has an aperture through which the monopole satellite positioning system antenna is deployed from the docked position to the deployed position substantially external to a housing of the portable wireless communication device.

15. The device according to claim 1, wherein the satellite positioning system antenna is a monopole satellite positioning system antenna having a first end attached to a housing of the portable wireless communication device and a second end attached to a microstrip patch antenna, wherein the microstrip antenna is at least a cellular patch antenna, wherein in the docked position the second end of the satellite positioning system antenna is substantially adjacent the housing and wherein in the deployed position the second end of the satellite positioning system antenna is orientated away from the housing.

16. The device according to claim 1, wherein the satellite positioning system antenna is rotated from a docked position adjacent a housing of the portable wireless communication device to a deployed position in which the satellite positioning system antenna has one end positioned away from the housing.

17. A portable wireless communication device, comprising:

a housing;

a satellite positioning system receiver communicably coupleable to a first antenna, the satellite positioning system receiver disposed within the housing;

a second antenna communicably coupleable to the satellite positioning system receiver, the second antenna movable between a docked position and a deployed position, the second antenna is disposed substantially within the housing in the docked position, the second antenna protruding substantially from the housing in the deployed position.

18. The portable wireless communication device of claim 17, the first antenna communicably coupled the satellite positioning system receiver when the second antenna is in the docked position, the second antenna communicably coupled the satellite positioning system receiver when the second antenna is in the deployed position.

19. The portable wireless communication device of claim 17, a deployment system connected to the second antenna, the deployment system moving the second antenna from the docked position to the deployed position in response to an occurrence of a deployment event.

20. A portable wireless communication device, comprising:

at least one of a wireless receiver and wireless transmitter;

an antenna coupled to the at least one of the wireless receiver and wireless transmitter;

an antenna deployment system having a solenoid operatively coupled to antenna, an antenna chamber, the antenna substantially contained within an antenna chamber, the antenna movable between a docked position and a deployed position extending at least partially from the antenna chamber, the antenna movable to one of the docked position or the deployed position when the solenoid is energized.

21. The device of claim 20, the antenna chamber is disposed within a housing of the portable wireless communication device.

22. The device of claim 20, the solenoid having a coil and a plunger, the solenoid contained within the antenna chamber, the plunger having an end coupled, to the antenna, wherein the plunger moves the antenna from the docked position to the deployed position upon energizing of the coil.

23. A portable wireless communication device, comprising:

a patch antenna having an aperture;

a monopole antenna;

the monopole antenna movable between a docked position and a deployed position, the monopole antenna is located so that the monopole antenna extends through the aperture of the patch antenna during movement to one of the docked and deployed positions.

24. The device of claim 23, a radio device coupled to the patch antenna;

a satellite positioning system receiver coupled to the monopole antenna, wherein the monopole antenna is located so that the monopole antenna extends through the aperture of the patch antenna during movement to the deployed position.

* * * * *